US005662205A

United States Patent [19]

Levasseur

[11] Patent Number: 5,662,205

[45] Date of Patent: Sep. 2, 1997

[54] COIN DETECTION DEVICE

[75] Inventor: Joseph L. Levasseur, St. Louis County, Mo.

[73] Assignee: Coin Acceptors, Inc., St. Louis, Mo.

[21] Appl. No.: 333,842

[22] Filed: Nov. 3, 1994

[51] Int. Cl.[6] ..... G07D 5/08

[52] U.S. Cl. ..... 194/317; 194/332

[58] Field of Search ..... 194/317, 318, 194/319, 328, 330, 332

[56] References Cited

U.S. PATENT DOCUMENTS

| | | | |
|---|---|---|---|
| 4,275,806 | 6/1981 | Tanaka et al. | 194/317 |
| 4,483,431 | 11/1984 | Pratt | 194/332 X |
| 4,625,852 | 12/1986 | Hoormann | 194/317 |
| 4,646,904 | 3/1987 | Hoormann | 194/334 |
| 4,664,244 | 5/1987 | Wright | 194/317 |
| 4,696,385 | 9/1987 | Davies | 194/319 |
| 4,967,895 | 11/1990 | Speas | 194/200 |
| 5,020,653 | 6/1991 | Shimizu | 194/317 |
| 5,191,956 | 3/1993 | Ibarrola | 194/317 |

FOREIGN PATENT DOCUMENTS 2266804 10/1993 United Kingdom .

OTHER PUBLICATIONS

*Coin Recognition Device,* IBM Technical Disclosure Bulletin, vol. 31 No. 11, Apr. 1989, 194–332.

*Primary Examiner*—F. J. Bartuska

*Attorney, Agent, or Firm*—Haverstock, Garrett and Roberts

[57] ABSTRACT

A device for sensing predetermined characteristics of an object such as a coin in order to determine the validity or genuineness of the coin and in some cases also the size and/or denomination of the coin, the device including a combination of optical sensors and an associated electromagnetic sensors which operate together to expose the coin in different positions to the field produced by the electromagnetic sensors so that if there are variations in the coin such as variations in the materials from with the coin is made these can be sensed and used to determine the coin's validity.

15 Claims, 2 Drawing Sheets

COIN DETECTION DEVICE

There are many coins and tokens in use in the world which are constructed with a concentric outer rim portion which is of a different metal than the center portion. This can complicate coin sensing devices including devices that produce electromagnetic fields through which or along which the coin passes. Also, coin sizes may be larger than the sensors that are used to test them, and therefore the sensor would miss the coin's outer rim portion if tested in a centered position. On the other hand, if a test is made in an off centered position, the test of two metal types in the same coin in combination will be dependent on or affected by the amount that the coin is off center when tested. Such an off center test would not be accurate unless there was some way to predetermine the exact position of the coin during the off center test. There are also coins that have openings or holes through the center thereof. Such coins present similar problems of testing and the present means can be used to test such coins also.

The present invention teaches the use of a device and a method of using it for determining the metallic characteristics of a coin or token by inductively sensing the coin or token while it is substantially centered over the inductive sensor, and again when its edge or rim portion is centered or substantially centered on the inductive sensor. This can be accomplished by providing optical means such as an optical beam of light which passes through the center of the inductive sensor, and detects the transition (the beam of light breaking and making) by the coin. If this is done the inductive sensor can be controlled to provide a reading of the coin's extremities which includes its outer rim or ring portion. This reading can be made to occur at the designated position of the coin edge at the time the optical beam makes or breaks. The outer rim area may or may not be sensed at all when larger coins are tested or sensed in the centered position of the inductor. Some slugs have been made using a genuine coin of a smaller diameter and adding a ring of plastic or other material around it thereby causing its overall diameter to be the same as that of a larger value or denomination coin. Under these circumstances it becomes imperative to validate both the inner and outer areas of the coin or token in order to be sure that the coin is a valid coin.

DISCUSSION OF THE PRIOR ART

Two patents which are forerunners of the present application are Hoorman U.S. Pat. No. 4,625,852 and Hoorman U.S. Pat. No. 4,646,904. These patents relate to coin detection, validation and sizing and include some features which in the general sense relate to the present invention. Both of these patents are assigned to Applicant's Assignee. The earlier of these two patents includes a tinging circuit operatively connected to a validation control circuit and includes a monitoring circuit connected to the ringing circuit to respond to particular damped wave output signal characteristics. The other patent relates to coin sizing wherein a coin moves along a coin path adjacent to first and second spaced sensors positioned to detect movement of the deposited coin thereby. Neither of the reference patents nor Applicant's application Ser. No. 08/220,790 now Pat. No. 5,460,256 disclose a device like the present device which uses optical sensors to control the reading of responses produced by electro-magnetic sensor means in predetermined positions of the coin and particularly positions where the coin being detected has a central position of one material or metal and a peripheral or rim portion formed of a different material or metal. The prior art devices therefore do not address the problem of validating coins made of more than one different material. The present invention can also be used to distinguish and identify and validate coins that have holes or openings at the center thereof.

OBJECTS OF THE INVENTION

It is a principal object of the present invention to provide means to avoid inaccurate detection and identification of coins, and especially coins that have a center portion of one material or metal surrounded by an area of a different metallic portion.

Another object is to minimize losses in vending machines and the like due to the customer using a coin formed of more than one different material.

Another object is to provide means for actuating sensing means used for sensing coins made having distinct portions of at least two different materials.

Another object is to provide means for accurately validating coins with openings or holes through the center or other portions thereof.

Another object is to reduce losses in vending and the like machines.

These and other objects and advantages of the present inventions will become apparent after considering the following detailed specification in conjunction with the accompanying drawings and a brief description of the drawings.

DETAILED DESCRIPTION OF THE PREFERRED EMBODIMENTS

Figure 1:
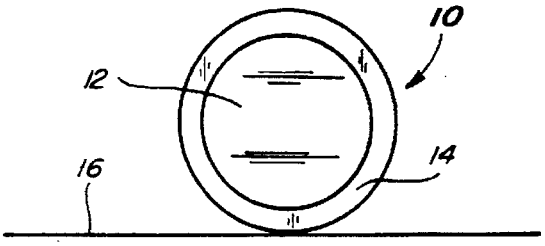
FIG. 1 is a side elevational view of a coin having a center portion formed of one material and a peripheral or rim portion formed of a different material.
Figure 2:
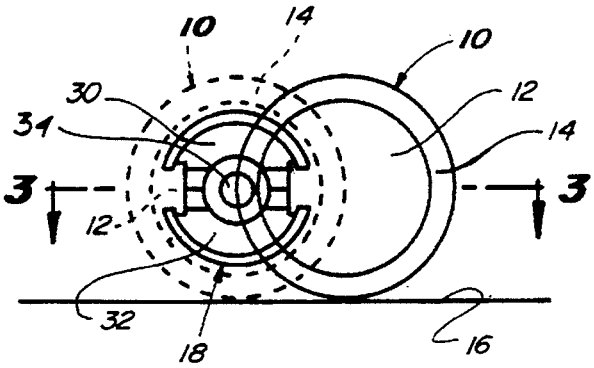
FIG. 2 is a side elevational view of the coin of FIG. 1 shown in various positions relative to a combination inductive and optical sensor device constructed according to the present invention.
Figure 3:
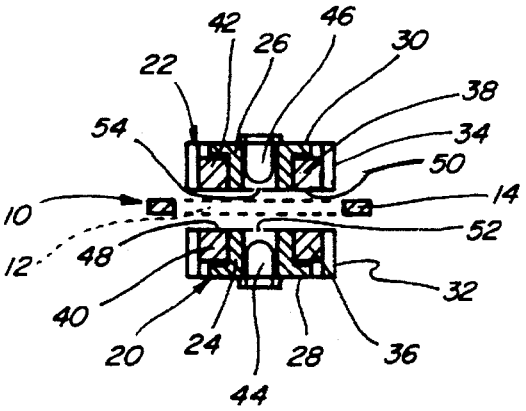
FIG. 3 is a cross-sectional view of the sensor shown in FIG. 2 taken along the line 3—3.
Figure 5:
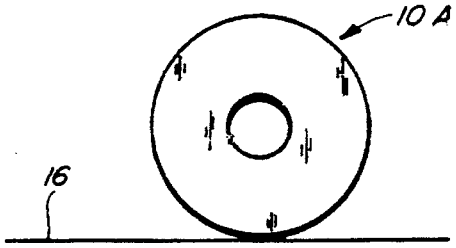
FIG. 5 shows a coin with a hole therethrough that can be tested by the present device.
Figure 4A:
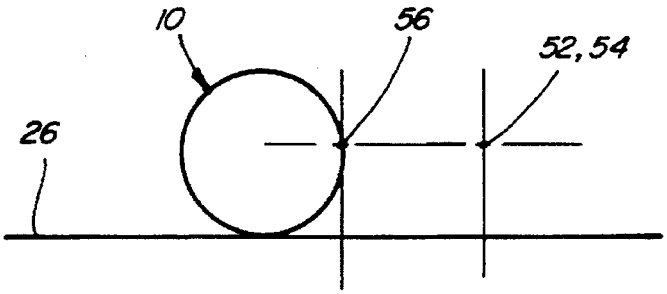
FIGS. 4*a*–4*e* show the coin of FIG. 1 in various positions and corresponding voltage changes during passage of the coin by a sensor device constructed according to the present invention.
Figure 4B:
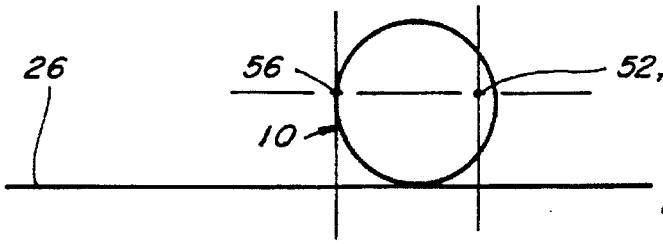
Figure 4C:
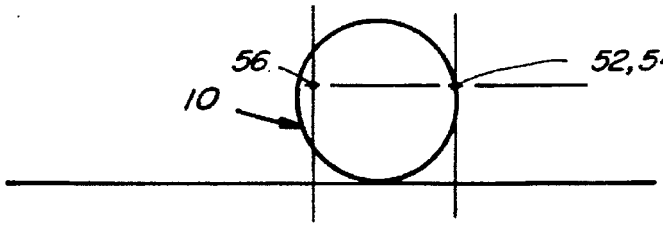
Figure 4D:
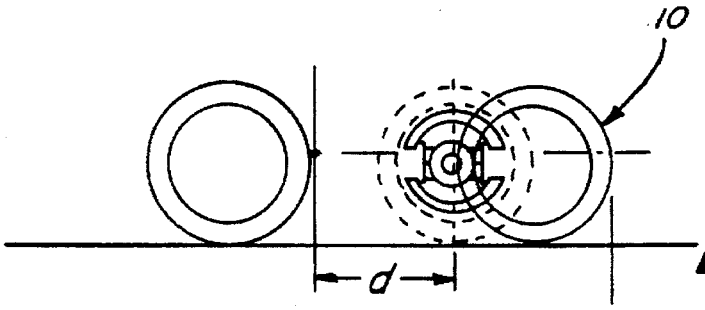
Figure 4E:
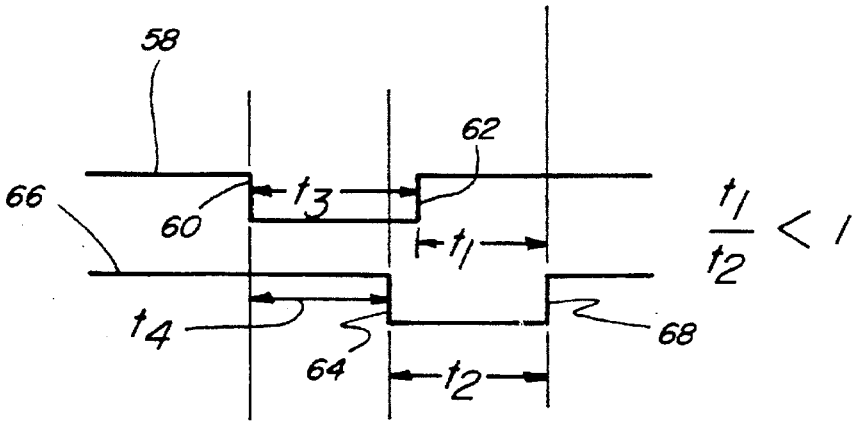

Referring to the drawings more particularly by reference numbers, number 10 in FIG. 1 (and 10A in FIG. 5) refers to a coin having a center area 12 constructed done material and a peripheral rim portion 14 constructed of a different material. In FIG. 2 the coin 10 is shown positioned on a rail 16 such as a rail in a vending machine along which coins move as they enter the machine and/or are evaluated for genuineness and denomination. Several different positions for the coin 10 are shown, in FIG. 2 including one position where the coin is centered on an inductive sensor pot core device 18 which is formed in two aligned similar portions 20 and 22 located on opposite sides of the rail 16 as shown in FIG. 3. Each of the portions 20 and 22 has an inner annular flange 24 and 26, a base portion 28 and 30 and an outer flange portion or portions 32 and 34. The flanges and base portions form annular chambers 36 and 38 in which are respectively located coils 40 and 42. Also positioned within the respective inner annular flanges 24 and 26, are a light source 44 and a photocell 46. Closing the annular chambers 36 and 38 in which the coils 40 and 42 are located are wall members 48 and 50. The wall member 48 has an aperture 52 located at its center and the wall member 50 has an aligned aperture 54 also located at its center.

In FIGS. 2 and 3, the coin 10 is shown positioned in the space between the pot cores 20 and 22 blocking light from the light source 44 from reaching the photocell 46.

In FIG. 3 the coin 10 is shown with the center portion 12 centered on and between the respective pot cores 20 and 22 with the rim portion 14 positioned outside of the inductive field produced by the coils 40 and 42. In this position light from the photo-emitter 44 is not able to pass through the aligned 52 and 54 and fall on the photocell 46. The size and shape of the light beam is controlled by the size and shape of the apertures 52 and 54 which are made small enough to provide accurate detection of a coins arrival and departure. In other words as a coin enters the space between the apertures 52 and 54 it will block light from the photo-emitter 44 reaching the photocell 46 and when the coin moves along and leaves the area between the apertures 52 and 54 the light beam will be reestablished between the members 44 and 46.

In FIG. 2, the coin 10 is shown moving to the right at the point where its trailing edge is just beginning to leave the area between the apertures 52 and 54 and is about to reestablish optical communication between the photo-emitter 44 and the photocell 46. In this position the outer or rim portion 14 of the coin extends across the space between coil windings 40 and 42 which when actuated sense the resultant metallic affect on the electro-magnetic field produced thereby. The affect is that the rim portion 14 in combination with other adjacent portions of the coin are in the field of the coil sensors. The type of materials, their sizes, areas and the thickness of the coin all play a part in this outer rim sensing of the coin. Whenever this test is made the edge or near edge portion of the coin passes through the center of the coils 40 and 42. The same test can also be used when the coin first reaches and interrupts the optical path and similar tests can be used to create a profile of the electro-magnetic affects on the coin.

FIGS. *4a–4d* show different positions of the coin 10 relative to the optical sensors 52, 54 and 56. The drawings shown are similar to those shown in application Ser. No. 08/220,790, filed Mar. 31, 1994 now Pat. No. 5,460,256 and assigned to Applicant's Assignee. FIGS. *4a–4d* illustrate, in conjunction with FIG. *4e*, coin positions and voltage changes as the coin moves past the sensor locations 52, 54 and 56. There is blocking of the first optical sensor location 56 which occurs when the leading coin edge is interrupting the first optical sensor 56 only and is upstream relative to the aligned apertures 52 and 54. When a coin moves to the position shown in FIG. *4a* it operates to break the optical path of the optical sensor at location 56 and hence reduces (or increases) the voltage of the photocell associated therewith. This is illustrated by a decrease in the voltage 58 that takes place at 60 in FIG. *4e*. The voltage will remain low for the time $T_3$ or until the trailing edges of the coin 10 reestablishes the optical path when the leading coin edge is at 62 as shown in FIG. *4b*. At some point during movement of the coin between the points shown in FIGS. *4a* and *4b* the leading edge of the coin will move between the apertures 52 and 54 and break optical communication between the photo-emitter 44 and the photocell 46. This position is illustrated in FIG. *4c* and by the location 64 on the voltage curve 66 shown in FIG. *4e*. By the time the coin 10 reaches the point at the right shown in FIG. *4d*, light will be reestablished between the photo-emitter 44 and the photocell 46. This is illustrated by the increase in voltage at 68. The coin 10 shown in FIG. *4a–4d* has a center portion 12 which is of a different material than the outer or rim portion 14 mentioned above (FIG. 1). It is therefore important to energize the coils 40 and 42 in the sensors 20 and 22, respectively so that the coils will be energized when the center portion 12 of the coin 10 is centered on the coils as well as when the coils are centered on or near the edge portion 14 of the coin 10 (FIG. 3). This is illustrated in FIG. *4d* where the coin is shown in dotted outline centered on the sensor units 20 and 22 and where the edge portion of the coin is shown in solid line centered on the sensor unit in the right most position of the coin in FIG. *4d*. The initial blocking of light at the sensor 44 and 46 (64 in FIG. *4e*) will energize the coils or generate changes therein when exposed to the center portion of the coin 10. In like manner, when the coin has moved so that its leading edge is at 68 (FIG. *4e*) it will reestablish light between the photo-emitter 44 and the photocell 46 and this in turn will energize the coils 40 and 42 or generate changes therein when exposed to the edge portion 14 of the coin 10. Thus information will be obtained as to the size of the coin by means of the optical sensors and the interruptions of light therefrom and it will also expose the coin in different positions, but accurately, to the electro-magnetic field generated by the magnetic sensor means, which at one time will be looking at the center portion 12 of the coin and at another time at or near the edge portion 14 of the coin 10. These readings are necessary to determine if the coin meets certain criteria as to its validity. Once the time $T_3$ has been measured (FIG. *4e*) then it is possible to calculate the size of the coin, i.e., how long it took to cover the optical sensor 56. With this information, take ½ of the time $T_3$ and add it to the time that commences at point 64. In other words start counting at 64 a time period equal to $T_3/2$ and at that time energize the electro-magnetic sensor to test the coins in that position. This provides an efficient and accurate means for determining the validity of coins and tokens including coins and tokens that may be constructed of a single or more than one metal or electro-magnetic material. Thus the present device can be used for various purposes including to validate known coins or tokens and with a high decree of accuracy.

The present invention therefore teaches the construction and operation of a device which combines optical sensor means with electro-magnetic or inductive sensor means in a way that enables different portions of the same coin to be exposed to the electro-magnetic means or inductors in different positions or in a plurality of different positions so as to determine if coins having different portions made of different materials are valid. The present invention can do this by exposing the different metallic portions of a coin to a magnetic sensor individually or in a sequence of positions to determine if the coin is valid and in some cases to establish a profile of the coin as it moves past the electro-magnetic sensor means. The present device can also be used to sense coins that have unusual physical characteristics such as coins that may have a hole or opening in the center thereof. The present invention can also be used to sense common everyday U.S. and foreign coins and to distinguish such coins from slugs and other invalid objects. This can be done in the same manner described above by exposing selectively different portions of each coin, token or other object to the electro-magentic sensor means in the manner described.

Thus there has been shown and described a novel coin sensing device which combines optical and electro-magnetic sensors to sense different distinct portions of a coin in order to determine if the coin meets certain criteria as to validity.

The device can also be used to combine a validity check with a coin dimensional check to determine the denomination of a coin once it has been determined the coin is valid. Many changes, variations, modifications and other uses in applications of the subject device are possible, and all such changes, variations, modifications and other uses in applications which do not depart from the spirit and scope of the invention are deemed to be covered by the invention which is limited only to the claims which follow.

What is claim is:

1. A device for sensing predetermined characteristics of an object such as a coin including a first sensor for optically sensing movement of the object thereby, a second sensor for optically sensing movement of the object thereby, and a third sensor including means for generating an electro-magnetic field in the region of the object when the object is in certain predetermined positions as determined by the first and second optical sensors, and means for reading the electro-magnetic field only when the coin is in one of the predetermined positions.

2. The device of claim 1 wherein the object is a coin having a central portion formed of a first material having predetermined electro-magnetic characteristics and a second portion surrounding the first portion formed of a material having different electro-magnetic characteristics, the means for reading the electro-magnetic field reading the electro-magnetic field when the central portion of the coin is positioned adjacent the third sensor and when the second portion of the coin is positioned adjacent the third sensor.

3. The device of claim 1 wherein the third sensor means includes a pot core member with a coil mounted thereon.

4. The device of claim 3 wherein the third sensor includes spaced opposed first and second pot core members each having an inner flange portion on which one of the coils is mounted, one of said pot cores being mounted on each opposite side of a coin track, said second optical sensor including a light source mounted in the inner flange of one of the pot cores, a light sensitive member mounted in the inner flange of the other pot core and a wall member mounted on each of said pot cores, said wall members having aligned apertures placing the light source and the light sensitive member in optical communication.

5. A device for sensing predetermined characteristics of an object such as a coin that has a central portion formed of one material and a peripheral portion formed of a different material including a track along which the coin moves during sensing, and sensors means mounted adjacent to the track including a first sensor for optically sensing the presence or absence of a coin moving thereby, a second sensor positioned adjacent to the first sensor including means for generating an electro-magnetic field in the region of the coin when the coin is in certain predetermined positions as determined by the first sensor, said first sensor establishing a condition wherein when the central portion of the coin is centered on the second sensor it generates an electro-magnetic field in the central portion, said first sensor establishing another condition when a predetermined portion of the peripheral portion of the coin is centered on the second sensor to generate an electro-magnetic field.

6. A device for sensing predetermined characteristics of a coin during movement thereof along a rail, the coin having a central region formed of a first material and a peripheral region extending therearound formed of a different material comprising first and second optical sensors positioned at spaced locations along the rail in positions to be optically blocked and unblocked by a coin moving thereby, a third sensor oriented symmetrically with respect to the second optical sensor for producing an electro-magnetic field in the region of the second optical sensor and extending across the path that the coin moves along on the rail, means for energizing the third sensor whenever a predetermined edge of the coin is uncovering the second optical sensor whereby the third sensor establishes an electro-magnetic field in the peripheral region of the coin, and means responsive to the re-establishment of the optical means associated with the first sensor for energizing the third sensor to establish an electro-magnetic field when the central region of the coin is in region of the third sensor.

7. A device for sensing predetermined characteristics of a coin having a central portion formed of a first material having predetermined electro-magnetic characteristics and a peripheral portion constructed of a material having different electro-magnetic characteristics comprising a track along which the coin moves, first and second spaced optical sensors positioned along the track in positions to be optically interrupted when a coin moves by, a third sensor energizable to generate an electro-magnetic field in a predetermined portion of the coin including when the central portion of the coin is adjacent thereto and when an edge portion of the coin is adjacent thereto, said third sensor including means responsive to the electro-magnetic field only when the electro-magnetic field is generated in one of the predetermined portions of the coin.

8. A device for sensing predetermined characteristics of an object such as a coin that has a central portion formed of a first material having predetermined electro-magnetic characteristics and a peripheral edge portion formed of a material having different electro-magnetic characteristics, an electro-magnetic sensor device positioned to produce an electro-magnetic field when different portions of the coin are adjacent thereto, comprising means for selectively reading the electro-magnetic field when the central portion of the coin is positioned adjacent to the sensor device and when the peripheral portion of the coin is positioned adjacent to the sensor device.

9. The device of claim 8 wherein the sensor device includes a pair of spaced and opposed pot cores each having a central annular flange and an outer flange defining a space therebetween and a coil positioned on each of the pot cores, the pot cores being positioned in alignment on opposite sides of the coin.

10. The device of claim 9 wherein light producing means are located inside of the inner annular flange on one of the pot cores and a light sensor device is positioned inside the inner annular flange on the other pot core, and means including aligned apertures positioned between the light producing means and the light sensor device whereby a coin positioned between the light producing means and the light sensor device interrupts the light therebetween and produces a voltage change in the light sensor device.

11. A device for sensing predetermined characteristics of an object such as a coin that has an opening therethrough at an intermediate location and is formed of a material having electro-magnetic characteristics, said coin being movable along a track, and sensor means mounted adjacent to the track including a first sensor for optically sensing that presence or absence of a coin moving thereby, a second sensor positioned adjacent to the first sensor including means for generating an electro-magnetic field in the region of the coin when the coin is in certain predetermined positions as determined by the first sensor, said first sensor establishing a condition wherein when the central portion of the coin is centered on the second sensor it generates an electro-magnetic field in the central coin portion, said first sensor establishing another condition when another portion of the coin is centered on the second sensor to generate an electro-magnetic field in the other portion of the coin.

12. A device for sensing predetermined characteristics of an object such as a coin including a track along which the coin moves during sensing, and sensors means adjacent to the track including a first sensor for optically sensing the presence or absence of a coin moving thereby, a second sensor positioned adjacent to the first sensor including means for generating an electro-magnetic field in the region of the coin when the coin is in certain predetermined positions as determined by the first sensor, said first sensor establishing a condition wherein when the central portion of the coin is centered on the second sensor it generates an electro-magnetic field therein, said first sensor establishing another condition when a different portion of the coin is centered on the second sensor to generate an electro-magnetic field.

13. A device for sensing predetermined characteristics of a coin constructed of a material having predetermined electro-magnetic characteristics comprising a track along which the coin moves, first and second spaced optical sensors positioned along the track in positions to be optically interrupted when the coin moves by, a third sensor associated with one of said first and second sensors to be selectively energizable to generate an electro-magnetic field in a predetermined portion of the coin including a first electro-magnetic field when a central portion of the coin is adjacent thereto and a second electro-magnetic field when a different portion of the coin is adjacent thereto.

14. A device for sensing predetermined characteristics of an object such as a coin including a first sensor for optically sensing movement of the object thereby, a second sensor for optically sensing movement of the object thereby, and a third sensor including means for generating an electro-magnetic field in the region of the object when the object is in certain predetermined positions as determined by the first and second optical sensors, the third sensor including a pot core, said pot core including spaced opposed first and second pot core members each having an inner flange portion on which a coil is mounted, one of said pot core members being mounted on each opposite side of a coin track, said second optical sensor including a light source mounted in the inner flange of one of the pot core members, a light sensitive member mounted in the inner flange of the other pot core member and a wall member mounted on each of said pot core members, said wall members having aligned apertures placing the light source and the light sensitive member in optical communication.

15. A device for sensing predetermined characteristics of an object such as a coin that has a central portion formed of a first material having predetermined electro-magnetic characteristics and a peripheral edge portion formed of a material having different electro-magnetic characteristics, an electro-magnetic sensor device positioned to produce an electro-magnetic field when different portions of the coin are adjacent thereto, comprising means for producing a first electro-magnetic field when the central portion of the coin is adjacent to the sensor device and a second electro-magnetic field when the peripheral portion of the coin is positioned adjacent to the sensor device, the sensor device including a pair of spaced and opposed pot cores each having a central annular flange and an outer flange defining a space therebetween and a coil positioned on each of the pot cores, the pot cores being positioned in alignment on opposite sides of the coin, light producing means located inside of the inner annular flange on one of the pot cores and a light sensor device positioned inside the inner annular flange on the other pot core, and means including aligned apertures positioned between the light producing means and the light sensor device whereby a coin positioned between the light producing means and the light sensor device interrupts the light therebetween and produces a voltage change in the light sensor device.

* * * * *

UNITED STATES PATENT AND TRADEMARK OFFICE

CERTIFICATE OF CORRECTION

PATENT NO. : 5,662,205
DATED : September 2, 1997
INVENTOR(S) : Joseph L. Levasseur

It is certified that error appears in the above-identified patent and that said Letters Patent is hereby corrected as shown below:

Column 1, line 52, "tinging" should be --ringing--.

Column 2, line 52, "done" should be --of one--..

Signed and Sealed this

Sixteenth Day of December, 1997

*Attest:*

*Attesting Officer*

BRUCE LEHMAN

*Commissioner of Patents and Trademarks*